US009202450B2

(12) United States Patent
Vainiala

(10) Patent No.: US 9,202,450 B2
(45) Date of Patent: Dec. 1, 2015

(54) METHOD AND APPARATUS FOR IMPULSE RESPONSE MEASUREMENT AND SIMULATION

(76) Inventor: Mikko Pekka Vainiala, Pori (FI)

( * ) Notice: Subject to any disclaimer, the term of this patent is extended or adjusted under 35 U.S.C. 154(b) by 589 days.

(21) Appl. No.: 13/554,142

(22) Filed: Jul. 20, 2012

(65) Prior Publication Data

US 2013/0022210 A1 Jan. 24, 2013

(30) Foreign Application Priority Data

Jul. 22, 2011 (GB) ..... 1112675.2

(51) Int. Cl.
*H04R 29/00* (2006.01)
*G10H 1/16* (2006.01)
*G10H 3/18* (2006.01)

(52) U.S. Cl.
CPC ..... *G10H 1/16* (2013.01); *G10H 3/187* (2013.01); *G10H 2210/311* (2013.01); *G10H 2250/111* (2013.01); *H04R 29/001* (2013.01)

(58) Field of Classification Search
CPC ..... H04R 29/001; G10H 1/16; G10H 3/187; G10H 2250/111; G10H 2210/311
USPC ..... 381/59, 96
See application file for complete search history.

(56) References Cited

U.S. PATENT DOCUMENTS 4,984,495 A 1/1991 Fujimori
6,282,296 B1 * 8/2001 Konno et al. ..... 381/96
8,538,042 B2 9/2013 Yang et al.

(Continued)

FOREIGN PATENT DOCUMENTS

EP 0505949 A1 9/1992
JP 05027770 A 2/1993

(Continued)

OTHER PUBLICATIONS

European Search Report. U.S. Pat. No. 120052903-2225. Date of completion of the search: Nov. 21, 2012.

(Continued)

*Primary Examiner* — Ping Lee
(74) *Attorney, Agent, or Firm* — Mollborn Patents, Inc.; Fredrik Mollborn

(57) ABSTRACT

A method of measuring an impulse response of an amplifier coupled in operation to a loudspeaker arrangement includes:

(a) coupling directly to a connection between the amplifier and the loudspeaker arrangement for obtaining access to a drive signal ($S_{amp}$) applied to the loudspeaker arrangement to generate an acoustic output ($S_2$);

(b) disposing a microphone arrangement for receiving the acoustic output ($S_2$) of the loudspeaker arrangement;

(c) using a test signal generator to apply a test signal ($S_{sw}$) to an input of the amplifier; and (d) receiving at a digital signal processing arrangement (DSP, 210) at least the drive signal ($S_{amp}$) and the acoustic output ($S_2$) corresponding to the test signal ($S_{sw}$) and performing on these signals a signal processing operation for determining an impulse response for at least one of: the amplifier, the loudspeaker arrangement.

11 Claims, 11 Drawing Sheets

(56) References Cited

U.S. PATENT DOCUMENTS

| | | | | |
|---|---|---|---|---|
| 2001/0038702 | A1* | 11/2001 | Lavoie et al. | 381/307 |
| 2005/0108004 | A1 | 5/2005 | Otani et al. | |
| 2007/0193435 | A1 | 8/2007 | Hardesty et al. | |
| 2007/0291952 | A1* | 12/2007 | Spielbauer et al. | 381/26 |
| 2011/0038490 | A1 | 2/2011 | Yang et al. | |
| 2013/0343573 | A1 | 12/2013 | Yang et al. | |

FOREIGN PATENT DOCUMENTS

| | | | |
|---|---|---|---|
| JP | 2003050582 | A | 2/2003 |
| WO | 0028521 | A1 | 5/2000 |
| WO | 2011019339 | A1 | 2/2011 |

OTHER PUBLICATIONS

Dolphin Music, "Universal Audio Premiers Studer A800 Multichannel Tape Recorder Plug in for UAD-2", Dec. 7, 2010, http://www.dolphinmusic.co.uk/article/4639-universal-audio-premiers-studer-a800-multichannel-tape-recorder-plug-in-for-uad-2.html [accessed Nov. 14, 2011].

United Kingdom Intellectual Property Office Search Report. Application No. GB1112675.2. Date of search: Nov. 15, 2011.

United Kingdom Intellectual Property Office Search Report. Application No. GB1112676.0. Date of search: Nov. 14, 2011.

USPTO Office Action. U.S. Appl. No. 13/554,219. Dated Feb. 14, 2014.

* cited by examiner

METHOD AND APPARATUS FOR IMPULSE RESPONSE MEASUREMENT AND SIMULATION

CROSS-REFERENCE TO RELATED APPLICATIONS

This Application claims priority to United Kingdom Patent Application No. 1112675.2 filed on Jul. 22, 2011, the entire content of which is incorporated herein by reference.

FIELD OF THE INVENTION

The present invention relates to methods of measuring impulse responses and for simulating such impulse responses, for example in respect of thermionic electron tube amplifiers and associated loudspeaker arrangements. Moreover, the present invention also concerns apparatus operable to implement aforementioned methods. Furthermore, the present invention also relates to software products recorded on machine-readable media, wherein the software products are executable on computing hardware for implementing aforementioned methods.

BACKGROUND

In respect of conventional acoustic musical instruments, as illustrated in FIG. 1, there is a sound source 10 under control of a musician 20, wherein an output $S_1$ from the sound source 10 is conveyed via a coupling arrangement 30 to generate an acoustic output $S_2$ which is eventually appreciated as an acoustic sound by the musician 20 and potentially other persons listening to the acoustic output $S_2$, for example an audience. The coupling arrangement 30 can be passive or active. "Active" corresponds to the output $S_1$ being subject to amplification to generate the acoustic output $S_2$.

An example of a passive implementation of the coupling arrangement 30 is a sound board of an acoustic piano; the sound source 10 in such case corresponds to a keyboard, a hammer mechanism, and a metal frame with piano "strings" stretched thereacross, wherein the keyboard receives from the musician 20 an input force via the keyboard to actuate the hammer mechanism to excite the "strings" into resonance to generate the output $S_1$. The coupling arrangement 30 implemented in a passive mode is beneficially analyzed, namely represented, as a series of resonances $R_1$ to $R_n$. The resonances $R_1$ to $R_n$ have corresponding Q-factors $Q_1$ to $Q_n$, corresponding coupling coefficients $k_1$ to $k_n$, and corresponding center frequencies $f_1$ to $f_n$. The resonances $R_1$ to $R_n$ are included within a frequency range of interest, for example 20 Hz to 20 kHz. Thus, the emitted sound $S_2$ is susceptible to being mathematically derived from the output $S_1$ by way of Equation 1 (Eq. 1):

$$S_2 = \sum_{i=1}^{n} k_i R_i S_1 \qquad \text{Eq. 1}$$

In practice, suitable selection of the resonances R and their associated resonant frequencies, together with the coupling coefficients k are vitally important when manufacturing a quality acoustic musical instrument, for example when constructing a quality grand piano or a quality acoustic guitar, because the coupling arrangement 30 causes distinct coloration of the output $S_1$ which enables the acoustic instrument to be recognized and appreciated by the musician 20 and potentially other persons listening to the acoustic output $S_2$. For accurately describing an acoustic instrument, the number n of resonances R employed in Equation 1 (Eq. 1) can be potentially very large, for example several hundred to several thousands.

In a high-fidelity sound reproduction system, the sound source 10 is, for example, a CD player including a high-quality DAC output or similar to generate the output $S_1$, and the coupling arrangement 30 is implemented as an amplifier arrangement coupled to a loudspeaker arrangement and is carefully designed to be as accurate as possible so that the acoustic output $S_2$ is as faithful a reproduction of the output $S_1$ as technically possible. Special measures, for example use of electrostatic speakers and class-A solid-state linear amplifiers, are sometimes employed to achieve most accurate sound reproduction in top quality high fidelity sound reproduction systems.

Another example of an active implementation of the coupling arrangement 30 is a thermionic electron tube amplifier 50 with an associated loudspeaker arrangement 60 as illustrated in FIG. 2. The thermionic electron tube amplifier 50, also known as a "valve" amplifier, is arranged in operation to receive an electrical signal as the output $S_1$ from a pickup of an electric guitar 10, and to amplify the output $S_1$ to generate a corresponding acoustic output $S_2$ from the loudspeaker arrangement 60. Well known commercial companies such as Marshall Amplification (United Kingdom), Peavey (United States of America), Fender (United States of America) manufacture such active sound amplification apparatus, although there are many alternative manufacturers of active sound amplification apparatus in the World competing for market share; "Marshall", "Peavey" and "Fender" are registered trade marks (®). Musicians skilled in playing electric guitars contemporarily greatly enjoy employing valve amplifiers and associated loudspeaker arrangements for generating the acoustic output $S_2$. Such enjoyment derives from considerable sound coloration introduced in operation by such valve amplifiers and associated loudspeaker arrangements. When sound coloration occurs, the coefficients k and Q-factors Q of the resonances R in Equation 1 (Eq. 1) are contemporarily perceived to vary considerably over the frequency range of interest.

Certain constructions of the loudspeaker arrangement 60, namely including one or more loudspeaker driver units 100, referred to as "drivers", and their associated one or more cabinets 110, have certain distinctive sound coloration characteristics. In contradistinction, in the case of high-fidelity apparatus, it is desirable that the sound coloration should be small as possible. The distinctive sound coloration characteristics are potentially influenced by one or more of following factors:

(a) a physical shape and size of the one or more cabinets 110;

(b) a material from which the one or more cabinets 110 are fabricated, whether or not a volume enclosed by walls of the one or more cabinets 110 are at least partially filled with sound absorbing materials, whether or not the walls of the one or more cabinets 110 present the volume with irregular surface topology or one or more planar surfaces, and whether or not the one or more cabinets 110 are of a back-vented configuration or infinite-baffle closed construction;

(c) a material from which diaphragms of the one or more loudspeaker driver units 100 are manufactured, a geometrical shape of the diaphragms, and an elasticity of their spider mounts and roll surrounds which are employed to center and support the diaphragms; and (d) a manner in which the one or more loudspeaker driver units 100 are spatially disposed in the one or more cabinets 110.

For example, it is conventional practice to construct the one or more cabinets 110 from solid wood, plywood, medium density fiber board (MDF) or chipboard panels which are at least partially filled with acoustic wadding, and the one or more driver units 100 are manufactured with diaphragms manufactured from stiffened impregnated paper or cloth. Occasionally, more exotic materials such as Titanium, Kevlar or Carbon fiber are employed for fabricating the diaphragms; "Kevlar" is a registered trademark (®).

It has become contemporary practice to provide musicians with a musician-selectable simulation, namely synthesis or emulation, of different amplification system colorations in their sound amplification equipment; for example, such selection is contemporarily provided as a user-selectable option by way of a rotatable switch or equivalent on amplifier units. These simulations, namely amplifier emulations, are optionally provided for example in a context of "combo units" wherein the valve amplifiers 50 and the one or more loudspeaker driver units 100 are housed together as integrated apparatus. These emulations may alternatively be implemented via processing software when processing recorded signals for producing musical products such as compact discs (CD) and sound files for subsequent distribution to customers. The musicians are thereby able to select between supposedly different types of loudspeaker arrangements and associated thermionic electron tube amplifiers to achieve a desired musical effect, namely sound coloration, for example in response to an epoch of music being performed. It is contemporary practice that the simulations be conventionally derived from a measurement and associated analysis of an input signal, equivalent to the output $S_1$, to a thermionic electron tube ("valve") amplifier and a corresponding acoustic output, equivalent to the acoustic output $S_2$, from a speaker arrangement coupled to the amplifier, wherein the acoustic output $S_2$ is measured using a high quality microphone which is conventionally assumed to be substantially devoid of coloration effects; by analyzing the acoustic output derived from the microphone relative to the input signal $S_1$ to the valve amplifier by way of an impulse pulse response and/or a swept frequency response and performing a form of mathematical processing, for example a convolution or de-convolution, pursuant to Equation 1 (Eq. 1), it is feasible to provide aforesaid simulations, namely emulations. However, such an approach often does not provide a sufficiently accurate simulation, namely synthesis or emulation, in view of highly complex sound coloration process which occur in practice for a whole variety of reasons.

Contemporary combo amplifiers typically include an amplifier unit and one or more loudspeakers within a housing. Typically, the amplifier unit is usually implemented using thermionic electron tubes and/or analogue solid-state devices for providing signal amplification. Moreover, contemporary amplifier emulators attempt to simulate a sound of valve amplifiers or solid-state amplifiers using digital signal processing (DSP) and/or solid-state circuits. The emulators are often implemented in a contemporary context using software executable upon computing hardware. However, musicians find that contemporary simulation, namely emulations, are not sufficiently realistic and representative, despite contemporarily great care being taken when measuring characteristics of sound amplification systems In a published international PCT application no. WO 00/28521 (PCT/GB99/03753, "Audio dynamic control effects synthesizer with or without analyzer", Sintefex Audio LDA), there is described a method and apparatus for applying a gain characteristic to an audio signal. Data storing a plurality of gain characteristics at a plurality of different levels is stored in data storage means. The amplitude of an input signal is repeatedly assessed and from this a gain characteristic to be applied to the input is determined.

SUMMARY

The various embodiments of the present invention seek to provide an improved method of measuring an impulse response, for example an impulse response of a combination of a thermionic electron tube ("valve") amplifier and a loudspeaker arrangement.

Moreover, the various embodiments of the present invention also seeks to provide an apparatus which is operable to provide improved sound simulation, namely emulation, using impulse responses derived from the aforesaid methods of the invention.

According to a first aspect, there is provided a method as claimed in appended claim 1: there is provided a method of measuring an impulse response, wherein the method includes:

(a) coupling directly to a connection between the amplifier and the loudspeaker arrangement for obtaining access to a drive signal ($S_{amp}$) applied to the loudspeaker arrangement to generate an acoustic output ($S_2$);

(b) disposing a microphone arrangement for receiving the acoustic output ($S_2$) of the loudspeaker arrangement;

(c) using a test signal generator to apply a test signal ($S_{sw}$) to an input of the amplifier; and (d) receiving at a digital signal processing arrangement (DSP) at least the drive signal ($S_{amp}$) and the acoustic output ($S_2$) corresponding to the test signal ($S_{sw}$) and performing on these signals a signal processing operation for determining an impulse response for at least one of: the amplifier, the loudspeaker arrangement.

The embodiment is of advantage in that it enables an impulse response of the amplifier and the loudspeaker arrangement to be measured independently and more accurately, thereby generating more representative impulse responses, for example for use in subsequent synthesis, namely simulation or emulation.

Optionally, the signal processing operation includes at least one of: a convolution, a de-convolution, a frequency-domain analysis, a Fast-Fourier transform (FFT) or other mathematical operation.

Optionally, the method, for determining the impulse response, includes measuring at least one of:

(i) a harmonic sound coloration resulting from thermionic electron tube non-linear transfer properties in respect of the amplifier;

(ii) a harmonic sound coloration resulting from output transformer non-linear coupling properties in respect of the amplifier;

(iii) a harmonic sound coloration resulting from Doppler frequency shift occurring within one or more drivers of the loudspeaker arrangement arising from dynamic diaphragm movements;

(iv) a harmonic coloration resulting from non-linear properties of diaphragm suspension components of one or more drivers of the loudspeaker arrangement; and (v) one or more cavity and/or structural resonances of one or more cabinets employed for the loudspeaker arrangement, and their associated one or more drivers.

Optionally, the method includes employing the test signal generator (SWP) to apply a sweep frequency signal and/or a broadband test signal comprising a simultaneous plurality of signal components. More optionally, the method includes driving the amplifier at a plurality of power output levels in the acoustic output ($S_2$), and determining the impulse response in respect of each of the plurality of power output in the acoustic output ($S_2$).

Optionally, the method is implemented, such that the signal processing operation is a convolution that is performed using at least one of:

(a) Fast Fourier Transform (FFT) and/or Inverse Fast Fourier Transform (IFFT); and (b) one of more physical models describing transfer characteristics of active components present in the amplifier and/or the speaker arrangement.

Optionally, two sets of measurements are made when implementing the method including:

(i) applying a sweep signal ($S_1$) into the amplifier coupled at its output to the loudspeaker arrangement and measuring the acoustic output ($S_2$) from the loudspeaker arrangement for generating a first sample for the digital signal processing arrangement (DSP); and (ii) applying a dummy load to the amplifier in substitution for, or in addition to, the loudspeaker arrangement, applying the sweep signal ($S_1$) to the amplifier and measuring a second sample from the dummy load for the digital signal processing arrangement (DSP); and (iii) processing the first and second samples for identifying individual signal coloration contributions corresponding to the amplifier and the load speaker arrangement.

Optionally, the method includes deriving the drive signal ($S_{amp}$) by placing a dummy load in parallel with electrical connections to one or more drivers of the loudspeaker arrangement.

According to a second aspect, there is provided an apparatus for use in performing the method pursuant to the first aspect of the invention.

According to a third aspect, there is provided a software product recorded on a machine-readable data carrier, wherein the software product is executable upon computing hardware (DSP) for implementing a method pursuant to the first aspect of the invention.

According to a fourth aspect, there is provided an apparatus for use in performing the method pursuant to the first aspect of the invention, wherein the apparatus includes:

(a) a coupling arrangement for coupling directly to a connection between an amplifier and a loudspeaker arrangement for obtaining access to a drive signal ($S_{amp}$) applied to the loudspeaker arrangement to generate an acoustic output ($S_2$);

(b) a microphone arrangement for receiving the acoustic output ($S_2$) of the loudspeaker arrangement;

(c) a test signal generator for applying a test signal ($S_{sw}$) to an input of the amplifier; and (d) a digital signal processing arrangement (DSP) for receiving at least the drive signal ($S_{amp}$) and the acoustic output ($S_2$) corresponding to the test signal ($S_{sw}$) and for performing on these signals a signal processing operation for determining an impulse response for at least one of: the amplifier (50), the loudspeaker arrangement.

Optionally, the apparatus is implemented as a musical instrument amplifier including the signal processing arrangement, an amplifier and possibly a loudspeaker arrangement, wherein the signal processing arrangement is operable to apply in a user-selectable manner the one or more impulse responses to one or more signals passing through the amplifier to drive the loudspeaker arrangement. More optionally, the apparatus is implemented so that the signal processing arrangement is operable to apply solely an impulse response of one or more loudspeaker arrangements, so that an acoustic output ($S_2$) from the loudspeaker arrangement only includes harmonic coloration from one valve amplifier; this enables the coloration from different loudspeaker arrangements to be selected for a given power amplifier providing a drive signal.

It will be appreciated that features of the various embodiments of the invention are susceptible to being combined in various combinations without departing from the scope of the invention as defined by the appended claims.

DESCRIPTION OF THE DRAWINGS

Embodiments of the present invention will now be described, by way of example only, with reference to the following drawings wherein.

Figure 1:
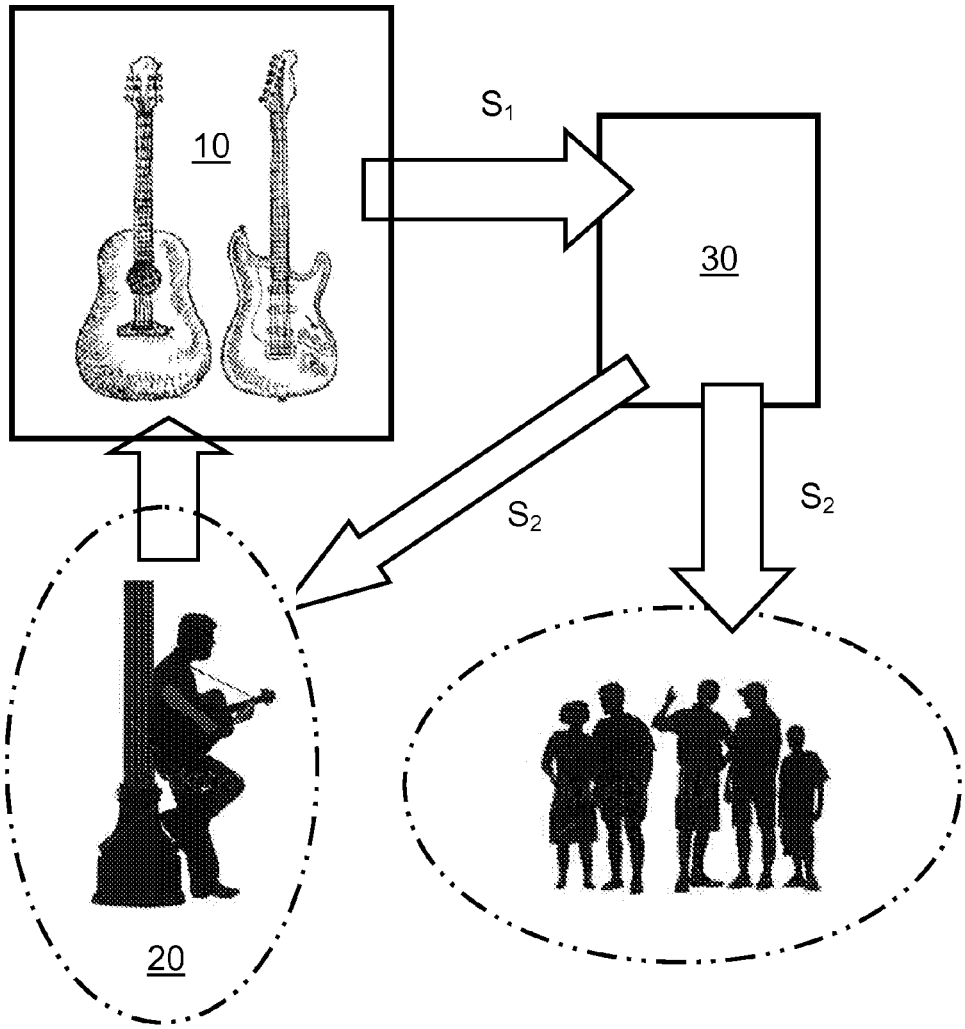
FIG. 1 is an illustration of a representation of a conventional musical instrument including an active or passive coupling arrangement.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION

In overview, aforementioned conventional approaches to providing sound simulation, namely synthesis or emulation, as described in the foregoing seek initially to measure tonal coloration caused by acoustic or electrical systems and to express such tonal coloration using, for example, one or more impulse responses. The one or more impulse responses are then subsequently used for processing uncolored sound signals to generate a simulation, namely a synthesis or emulation, of an expected acoustic output that would result from such signals being applied to the acoustic or electrical systems whose one or more impulse responses have been determined. The one or more impulse responses are thus useable in sound simulation apparatus and software for processing signals to provide user-desired coloration effects pursuant to the measured one or more impulse responses.

An impulse response represents a system's response to an impulse signal input applied to the system. For an acoustic system, for example an acoustic system represented by reverberation in a concert hall, the impulse input signal can be represented by a sound of a start pistol, and an impulse response is then represented as a resonance characteristic of corresponding reverberant sounds of the start pistol recorded in the hall after the start pistol has been fired. The impulse response represents effectively an acoustic signature of the acoustic system.

In practice, it is often not practical to measure an impulse response of a system by employing an impulse signal because such an approach often results in an unsatisfactory signal-to-noise ratio in the resulting measured impulse response, especially when the system has a limited dynamic range. The impulse response is often better measured using a broadband frequency excitation into the acoustic or electrical system. When employing such broadband frequency excitation, the impulse response can be determined using a mathematical processing method, for example a de-convolution, between the input signal applied to the system and the corresponding acoustic output signal provided from the system. Once determined by such de-convolution, the impulse response can be applied to signals to simulate, namely emulate, the acoustic or electrical system as aforementioned. Conveniently, measurement of the impulse response is referred to as being an analysis-phase, and subsequently applying the impulse response to some signal to synthesize a corresponding acoustic output signal is referred to as being a synthesis-phase. In a first respect, the present invention is concerned with methods and apparatus for performing the analysis-phase. Moreover, in a second respect, the present invention is concerned with methods and apparatus for performing the synthesis-phase.

The inventors of the various embodiments of the invention have appreciated that such a conventional impulse response pertains to a system which is assumed to be linear, namely to systems which do not cause significant distortion of signals transmitted therethrough. In practice, this means that conventional impulse response methods, for example contemporarily providing user-selectable speaker simulations in proprietary "combo" valve amplifier units or loudspeaker simulation systems, provide an unsatisfactory simulation of real guitar valve amplifiers and associated loudspeakers; real guitar amplifiers and associated speakers cause highly complex sound modification for a variety of reasons. Such highly complex sound modification will now be elucidated and is not contemporarily sufficiently appreciated by persons skilled in the art of impulse response measurement and simulation in respect of sound reproduction systems.

Thermionic electron tubes, also known as "valves", are often employed as active signal amplifying elements in guitar amplifiers, for example in loudspeaker-driving output stages operating in class A mode, or alternatively in class AB mode when higher output power are required. Such electron tubes have a transfer characteristic of anode current as a function of grid voltage, which is non-linear in nature, but typically is susceptible to being presented by a high-order polynomial or logarithmic-type mathematical function, for example embodying the conventionally known Dushmann equation of voltage-current transfer characteristics of an electron tube. Moreover, such thermionic electron tubes are required to operate at relatively high excitation potentials of several hundred volts which are generally not directly compatible with loudspeakers having corresponding coil impedances in an order of 3 to 16 Ohms and requiring significant drive currents of several amperes when in operation. It is thus conventional practice to employ magnetic matching transformers between output electron tubes of an electron tube power amplifier, for example KT66 or EL34 proprietary valve types, and one or more loudspeakers coupled to the output of the electron tube amplifier. On account of complex high frequency electrical resonances that magnetic output transformers are susceptible to exhibiting together with a relatively low response pole exhibited by such thermionic electron tubes when implemented as triodes, it is conventional practice to employ a relatively low forward gain in the thermionic tube amplifiers with corresponding low degrees of negative feedback around such amplifiers to define their overall amplification gain. A consequence of such an approach is that such valve amplifiers exhibit non-linearity characteristics in their gain response from their input to their output, whilst potentially low levels of transient intermodulation distortion (TID). Moreover, the aforesaid magnetic matching transformer employed to couple from one or more output electron tubes to the one or more loudspeakers is itself a non-linear component as a result of magnetic saturation effects that arise therein during operation when driven with large-amplitude signals. Such non-linear effects result in signal energy cross-coupling between the resonances R in Equation 1 (Eq. 1), which is not properly taken into account in contemporary impulse response simulations; the non-linearity results in subtle frequency multiplication of input signals as described in Equation 2 (Eq. 1):

$$S_{amp} = \sum_{j=1}^{m} A_j \sin(j\omega t + \theta_j) \qquad \text{Eq. 2}$$

wherein $S_{amp}$=output signal from the electron tube amplifier driving the one or more loudspeakers;

$S_1$=$A_0$ sin ωt, namely input signal to the electron tube amplifier;

A=amplification coefficient;

ω=input signal angular frequency;

t=time;

θ=relative phase angle of $j^{th}$ harmonic in the output driving the one or more loudspeakers; and m=a highest order of harmonic content generated by the electron tube amplifier.

In Equation 2 (Eq. 2), the coefficients A, and also potentially the angles θ, change depending upon an amplitude of the input signal and the amplifier gain selected by the user, in other words the output signal $S_{amp}$.

The output signal $S_{amp}$ is then itself employed to drive one or more loudspeakers to generate the aforementioned acoustic output $S_2$. However, a loudspeaker is itself a complex electromagnetic mechanical device despite its seemingly simple form of construction. By way of movement of a voice coil of the loudspeaker, especially when the loudspeaker is relatively efficient as is often a case for guitar combo amplifiers, the coil generates back e.m.f.'s due to loudspeaker diaphragm movement which is coupled back via the aforementioned transformer into the one or more output electron tubes of the amplifier and also influences a negative feedback network of the amplifier; this can subtly influence coupling between the resonances R in Equation 1 (Eq. 1). Moreover, it is conventional practice for guitarists to play their guitars with their corresponding valve amplifiers turned up to near full volume which results in considerable physical movement of one or more diaphragms of the one or more loudspeakers reproducing sounds generated by the guitarists' instruments; the diaphragms are required simultaneously to reproduce a broad spectrum of signal components which means that large diaphragm excursions needed for reproducing lower frequency signal components results in Doppler shift modulation being applied by the lower frequency signal components to higher frequency signal components, namely high-frequency "tizzying" effects, for example in a manner as described in Equation 3 (Eq. 3):

$$S_2 = \sum_{l=1}^{p}\sum_{h=1}^{q} B_{l,h}\sin(\omega_l t + \theta_l + D_{l,h}\sin(\omega_h t + \theta_h)) \quad \text{Eq. 3}$$

wherein $B_{l,h}$=loudspeaker coupling coefficient;

p=index defining signal component;

q=index defining signal component;

$\omega_l$=higher frequency signal component;

$\omega_h$=lower frequency signal component;

$D_{l,h}$=Doppler frequency shift coefficient which is a function of the amplitude of the signal $S_2$;

$\theta_l$=relative phase of signal component having angular frequency $\omega_l$; and $\theta_h$=relative phase of signal component having angular frequency $\omega_h$.

The Doppler shift is often perceived as a blurring effect that simultaneously adds a perceived "depth" to the sound reproduced.

Figure 2:
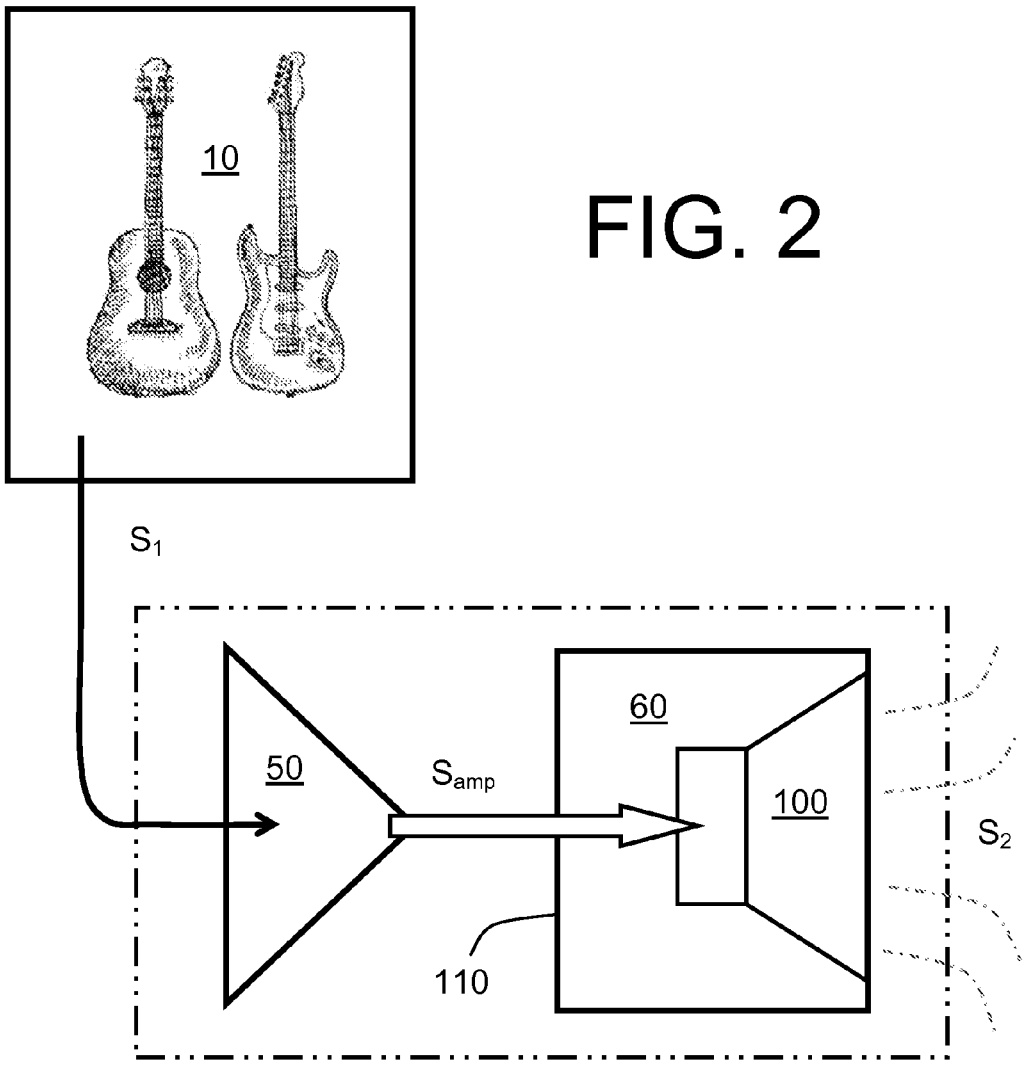
FIG. 2 is an illustration of an active implementation of the musical instrument in FIG. 1 utilizing a thermionic valve amplifier coupled to an associated loudspeaker arrangement.

In addition to Doppler effects described in Equation 2 (Eq. 2), referring to FIG. 2, the one or more cabinets 110 and the one or more loudspeaker drivers 100 will each also result in coloration pursuant to Equation 1 (Eq. 1), for example due to various subsidiary Eigenmodes in vibration patterns of conical diaphragms of the one or more drivers 100 as well as cavity resonances within an inner volume of the one or more cabinets 110, as well as Eigenmodes of structural resonance of the one or more cabinets 110.

From the foregoing, it will be appreciated that an accurate simulation, namely synthesis, of an acoustic output $S_2$ of a thermionic electron tube amplifier 50 coupled to one or more loudspeakers 110 when driven by an output signal $S_1$ of an electric guitar is a very highly complex challenge in view of complex and subtle colorations in the acoustic output $S_2$, especially when such complex and subtle colorations are also a function of an amplitude of the acoustic output $S_2$. Guitarists greatly enjoy such complex and subtle sound coloration because it provides fullness and excitement in the acoustic output $S_2$ relative to the signal $S_1$. Moreover, the sound coloration increases as the amplifier 50 is driven increasingly towards saturation, namely "soft" clipping; solid-state amplifiers often exhibit "hard" clipping which is perceived quite differently by guitarists. Some guitarists even enjoy the acoustic output $S_2$ when clipping occurs at the amplifier 50, wherein the amplifier 50 becomes significantly non-linear in its amplification characteristics; such clipping is for example much appreciated in vintage Hammond B3 tone-wheel organs provided with valve amplification. The coloration associated with Equations 2 and 3 (Eq. 2 and Eq. 3) results in complex signals in the acoustic output $S_2$ that the human brain finds challenging and interesting. Even the one or more drivers 100 can exhibit mechanical non-linearity as their diaphragms are instantaneously displaced to a limit of movement of their roll-surrounds and coil spider mounts, namely are subject to a mechanical form of signal clipping.

Contemporary impulse response simulations of the amplifier 50 coupled to the loudspeaker arrangement 60 based solely upon the application of Equation 1 (Eq. 2) represents a gross oversimplification of complex signal coloration processes which occur in practice as elucidated in the foregoing. Moreover, the amplifier 50 dynamically mutually interacts with the loudspeaker arrangement 60 such that dummy resistive loads applied to the amplifier 50 in substitution for the loudspeaker arrangement 60 will cause the amplifier 50 to function in a non-representative manner; this is a frequent oversight in conventional approaches of simulation, namely synthesis or emulation. A dummy resistive load, for example, does not exhibit dynamic inertial movement, which the one or more diaphragms of the one or more drivers 100 exhibit when in operation.

In order to further elucidate the various embodiments of the present invention, approaches to measure an impulse response of the valve amplifier 50 and loudspeaker arrangement 60 of FIG. 2 will be described, which will then be juxtaposed to alternative methods pursuant to the present invention.

Figure 3:
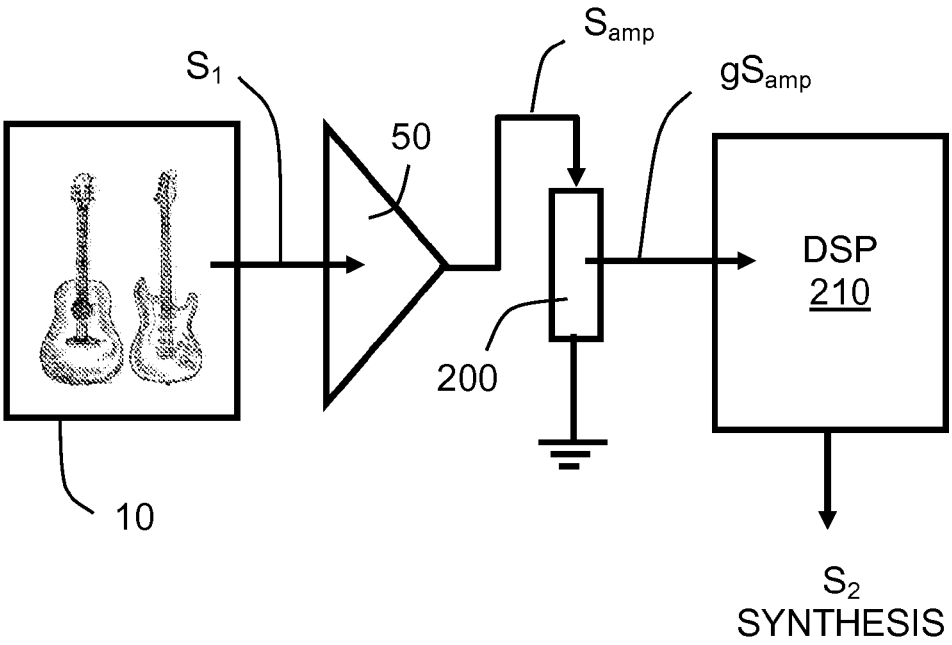
FIG. 3 is an illustration of an arrangement of apparatus pursuant to the present invention for simulating, namely synthesizing or emulating, an impulse response without needing to drive a loudspeaker arrangement.

According to an embodiment of the present invention, an artificial load 200 as illustrated in FIG. 3, conveniently implemented as a simple circuit including resistive elements, coupled to an output $S_{amp}$ of a valve amplifier 50. A portion of the signal $S_{amp}$, for example derived from a resistive potential divider included in the artificial load 200, is provided to a digital signal processing circuit board (DSP) 210. The DSP board 210 contains a library of pre-recorded impulse responses from several loudspeaker-microphone combinations. When performing synthesis, the DSP board 210 is operable to transform the signal $gS_{amp}$ to make it sound as though it had been generated by a loudspeaker arrangement 60 coupled to the valve amplifier 50, namely is capable of synthesizing, namely emulating, the acoustic output $S_2$. In other words, the artificial load 200 is beneficially employed instead of a loudspeaker arrangement 60 when implementing an emulation, namely synthesis. Such emulation enables, for example, recording to be performed without needing to generate high acoustic sound intensities.

Figure 4:
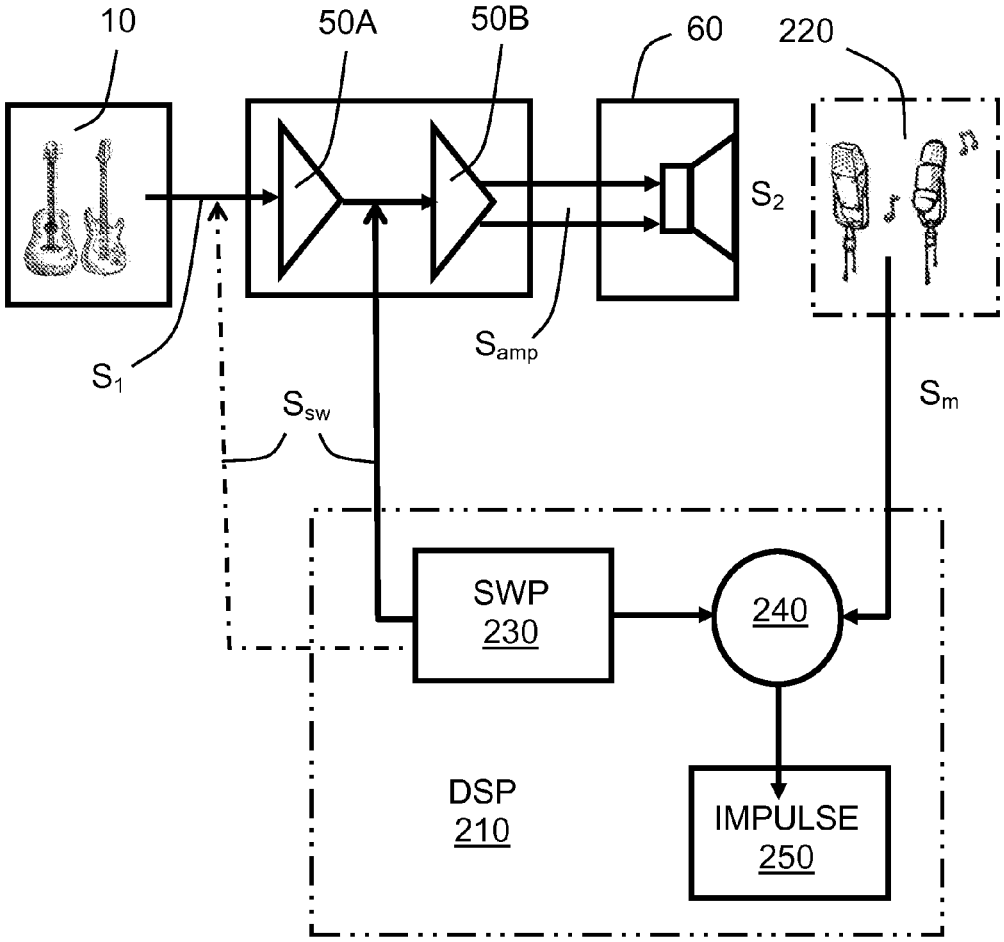
FIG. 4 is an illustration of a configuration of apparatus for measuring an impulse response of an amplifier and its associated loudspeaker arrangement.

Generation of the pre-recorded impulse responses will now be elucidated with reference to FIG. 4; this corresponds to the aforesaid analysis-phase.

In FIG. 4, a guitar 10 is coupled to a "valve" amplifier 50 including a pre-amplifier stage 50A and a power amplifier stage 50B; the power amplifier stage 50B is implemented using thermionic electron tubes, namely "valves". The "valve" amplifier 50 is coupled to a loudspeaker arrangement 60 including one or more loudspeakers. In such an arrangement in FIG. 4, playing the guitar 10 results in generation of the acoustic output $S_2$.

A microphone arrangement 220 including one or more microphones, for example high-quality condenser microphones, is coupled to the DSP board 210 and placed in a position to receive the acoustic output $S_2$ generated from the loudspeaker arrangement 60. The microphone arrangement 220 is a high quality apparatus which is preferably operable to provide a low degree of sound coloration for signals transduced therethrough, although some coloration therethrough will occur in practice; spatial positioning of the microphone arrangement 220 relative to the loudspeaker arrangement 60 is also a coloration-influencing factor, as well as a preamplifier employed in conjunction with the microphone arrangement 220. The DSP board 210 includes a sweep generator (SWP) 230 for injecting a sweep signal $S_{sw}$ between the pre-amplifier stage 50A and the power amplifier stage 50B as illustrated; conveniently, an effects-loop return jack connection of the amplifier 50 is employed for inputting the sweep signal $S_{sw}$ to the amplifier 50B. An example of the sweep signal $S_{sw}$ is a sinusoidal signal whose frequency is temporally swept from 80 Hz to 8 kHz, or a combination of a plurality of such swept sinusoidal signals. Whereas a single swept sinusoidal signal allows for propagation delays and resonances to be determined, a plurality of such swept sinusoidal signals allows for signal interaction effects, for example Doppler coloration, to be measured also. Beneficially, the sweep signal $S_{sw}$ is input either at an input to the power amplifier stage 50B or it can be input at a guitar input to the pre-amplifier stage 50A when a connection point between the amplifiers 50A, 50B is not accessible.

When executing a method of determining an impulse response of an arrangement as illustrated in FIG. 4, the sweep signal $S_{sw}$ is applied, for example, to the power amplifier 50B which correspondingly is used to drive the loudspeaker arrangement 60 and generate a corresponding microphone signal $S_m$ representative of the acoustic output $S_2$. The sweep signal $S_{sw}$ is usually a sinusoidal signal, or a concurrent plurality of such sinusoidal signals, which is temporally swept in frequency during a period of time in which data is collected at the DSP board 210. A de-convolution 240, or alternative mathematical function for providing impulse response analysis, is then applied to the data representative of the sweep signal $S_{sw}$ and the corresponding acoustic output $S_2$ as represented by the microphone signal $S_m$ to determine an impulse response 250 representative of the valve amplifier 50 and the speaker arrangement 60 and also that of the microphone arrangement 220. The impulse response 250 is, for example, a data set of parameters; the set of parameters can be used in conjunction with software executing on the DSP board 210 to provide a simulation, namely synthesis or emulation of the impulse response 250, namely when executing the aforementioned synthesis-phase.

It will be appreciated from the method executed in respect of FIG. 4 that the measured impulse response 250 contains substantially a combined acoustic fingerprint of all system parts substantially between the sweep generator (SWP) 230 and the microphone arrangement 220, more strictly all elements included between the signals $S_{sw}$ and $S_m$ in FIG. 4. On account of the amplifier 50 adding sound coloration in addition to the speaker arrangement 60, the impulse response 250 determined using the method is non-representative of, for example, solely the loudspeaker arrangement 60 and the microphone arrangement 220. Moreover, use of a single swept frequency for the sweep signal $S_{sw}$ does not enable coloration of the speaker arrangement 60 caused by intermodulation Doppler effects to be properly characterized. Thus, contemporary approaches represent merely a crude approximation for an impulse response. However, If the impulse response 250 determined by the DSP 210 is then employed subsequently in another amplifier-loudspeaker combination to simulate user-selectively an alternative type of system, the coloration due to a valve amplifier 50 is effectively added twice, creating a non-representative final acoustic effect. The present invention provides a solution to double inclusion of amplifier characteristics when executing the synthesis-phase.

Figure 5:
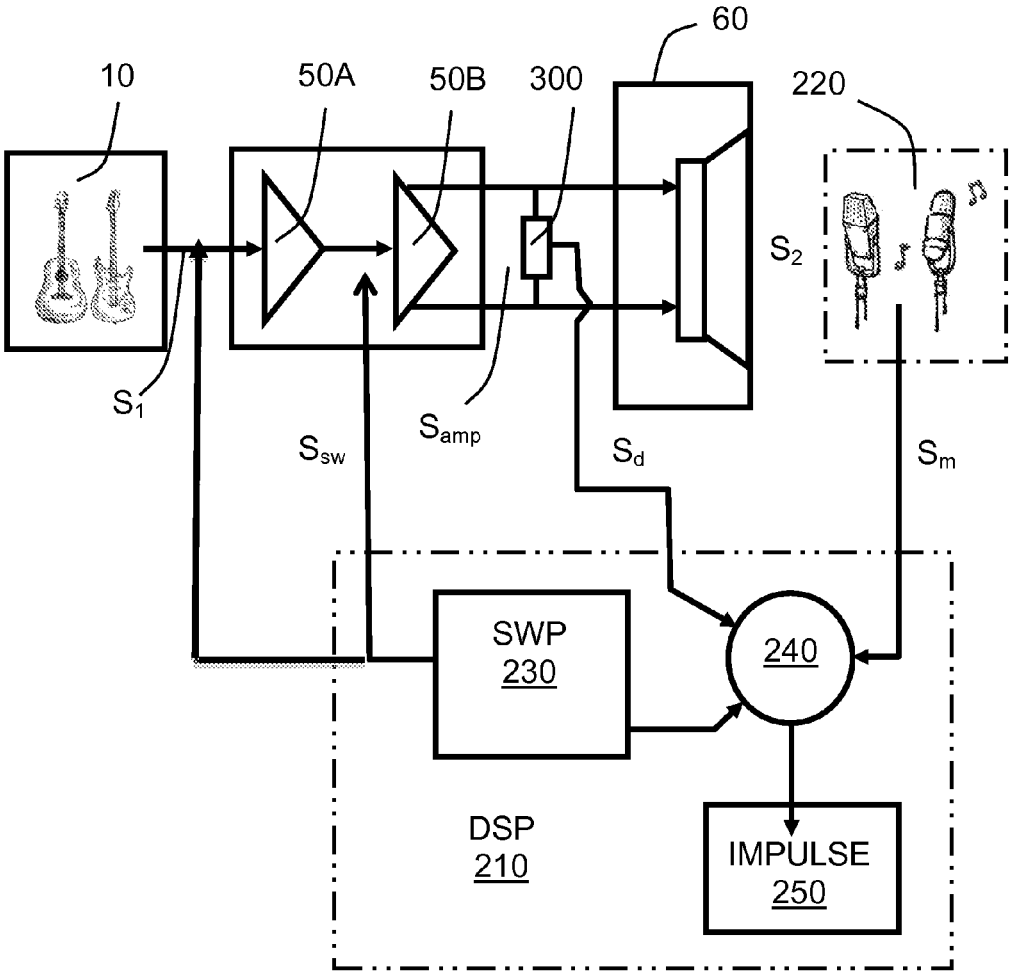
FIG. 5 is an illustration of an arrangement of apparatus pursuant to the present invention for measuring an impulse response of an amplifier and its associated loudspeaker arrangement.
Figure 6:
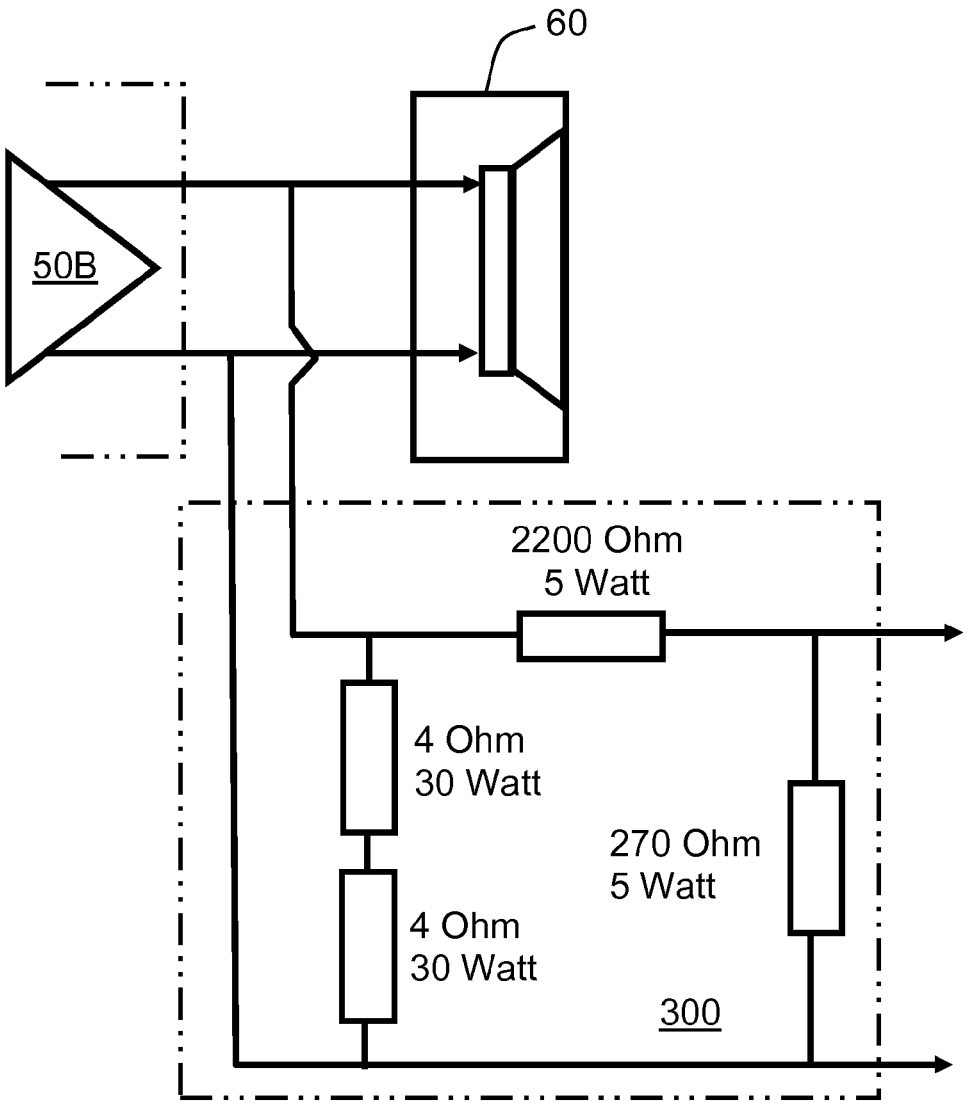
FIG. 6 is a circuit diagram of a dummy amplifier load for use when implementing the apparatus of FIG. 5.

Whereas FIG. 4, which represents a simpler approach to measure impulse response, the present invention more preferably employs an arrangement as illustrated in FIG. 5. The arrangement in FIG. 5 is similar to that in FIG. 4 with a modification that a dummy resistive load 300 is coupled in parallel with the loudspeaker arrangement 60 or in place of it, to provide a signal $S_d$ to the DSP board 210 in combination with the aforementioned microphone arrangement $S_m$ signal. The DSP board 210 is operable to generate the sweep signal $S_{sw}$ as before for feeding into the power amplifier 50B. Moreover, the sweep signal $S_{sw}$ is beneficially inserted into a guitar input of the amplifier 50 when of a "vintage" type wherein a connection point to a point between the preamplifier 50A and the power amplifier 50B is not available or accessible. Conveniently, the dummy resistive load 300 is implemented as depicted in FIG. 6. Optionally, the dummy load 300 includes reactive components wherein the dummy load 300 is varied in its impedance characteristics depending upon which loudspeaker simulation is to be selected.

In FIG. 5, the de-convolution 240 or other signal processing operation is performed between the output of the amplifier $S_{amp}$ driving the loudspeaker arrangement 60 and the microphone arrangement signal $S_m$. In consequence, when the swept signal $S_{sw}$ is applied, only the impulse response of the speaker arrangement 60 and the microphone arrangement 220 is derivable from the signals $S_d$ and $S_m$, whereas an overall impulse response of the amplifier 50 and the speaker arrangement 60 is derivable from the signals $S_{sw}$ and $S_m$. Optionally, the impulse response of solely the amplifier is derivable from the signals $S_{sw}$ and $S_d$ in representative operating conditions, namely the amplifier 50 is driving a real electromagnetic inertial load represented by the one or more drivers 100 of the loudspeaker arrangement 60. On account of the method of the present invention, for example implemented in respect of an arrangement of apparatus as illustrated in FIG. 5, the impulse response 250 obtained from the signals $S_m$ and $S_d$ in relation to the swept signal $S_{sw}$ represents extremely well the behavior of the loudspeaker arrangement 60 and the microphone arrangement 220. The inventors of the present invention have found from informal listening tests that it is virtually impossible to distinguish simulated, namely synthesized, sounds generated using the impulse response 250 from real studio-recorded guitar sounds. In other words, the present invention is capable of providing improved synthesis, namely emulation, during the aforementioned synthesis-phase.

Figure 7:
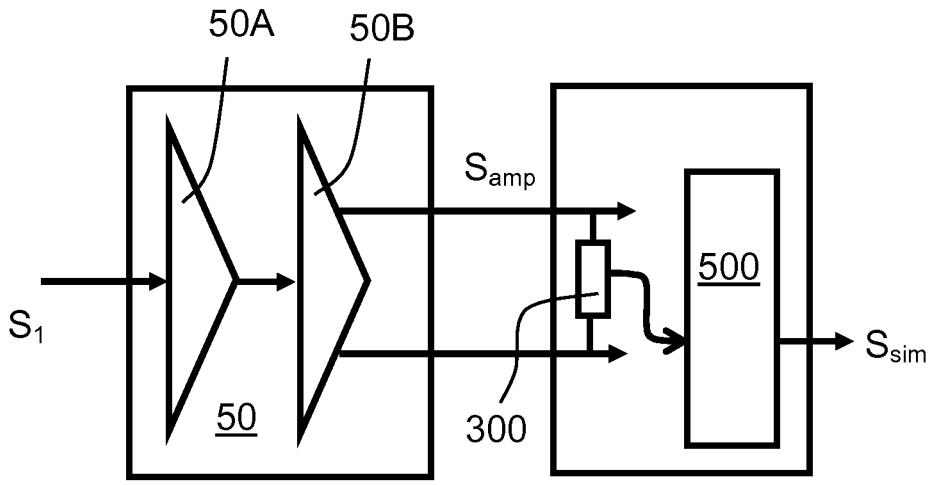
FIG. 7 is an illustration of a thermionic electron tube amplifier provided with an impulse synthesis functionality for enabling the amplifier to simulate various amplifier-speaker combinations whose impulse responses have been earlier measured and subsequently used in FIG. 7 for providing the functionality.

The impulse response 250 can be employed in a simulation, namely synthesis, arrangement as illustrated in FIG. 7; this corresponds to the aforementioned synthesis-phase. The arrangement in FIG. 7 employs the amplifier 50, but its loudspeaker arrangement 60 is disconnected. This is beneficial to do when it is desired not to generate a considerable acoustic output as occurs when the valve amplifier 50 is driven to function in combination with the loudspeaker arrangement 60 in a regime approaching clipping with large excursions of diaphragms of one or more drivers 100 in the loudspeaker arrangement 60.

In FIG. 7, the musician 10 couples his/her guitar to the amplifier 50 and an output $S_{amp}$ of the amplifier 50 is not fed to the loudspeaker arrangement 60, but rather solely to the dummy load 300 to generate the signal $S_d$ which is fed via a convolution 500 or other signal processing operation provided with the impulse response 250 derived in FIG. 5 from the signals $S_d$ and $S_m$ to generate a simulated output $S_{sim}$ in FIG. 7. $S_{sim}$ is an accurate representation of $S_2$ in FIG. 5, but without a need to generate vast amounts of acoustic energy from the speaker arrangement 60. This is a useful implementation in a compact recording studio where large sound intensities are generally not desired, for example for avoiding annoyance in a neighborhood of the compact recording studio. Moreover, the implementation is also useful when headphones are to be used and yet an emulation of a preferred amplifier and loudspeaker arrangement is desired, for example during musical instrument practicing.

In FIG. 5, a Volterra technique is alternatively employed as an alternative of computing the convolution 250. The Volterra technique involves computing a general system transfer function representative of the loudspeaker arrangement 60 being driven by the amplifier 50, for example by modeling physical processes occurring within the power amplifier 50B and the loudspeaker arrangement 60 as elucidated in the foregoing, for example Doppler effects, inertial effects and transfer function non-linearity effects giving rise to harmonic generation in the acoustic output $S_2$. Such a Volterra technique can be implemented as a Fast Fourier Transform (FFT) mapping function whose mapping parameters are modulated by an instantaneous amplitude of the signal $S_d$ when performing sound coloration synthesis. Alternatively, an Inverse Fast Four Transform (IFFT) approach can be adopted.

Figure 8:
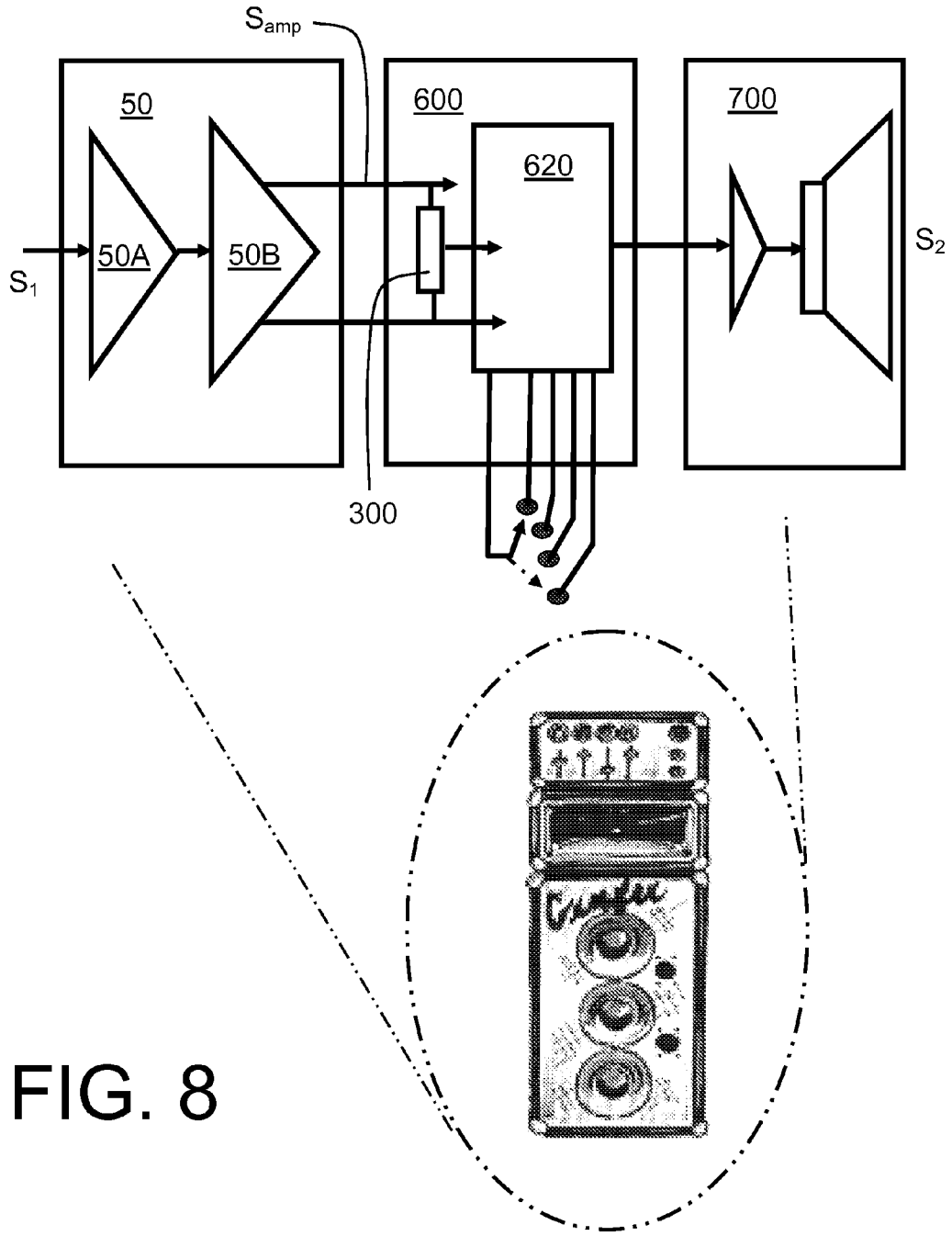
FIG. 8 is an illustration of an example of a thermionic valve amplifier combo with integrated speaker and including impulse response simulation functionality pursuant to the present invention.

A potential commercial application of the present invention is illustrated in FIG. 8, wherein a valve combo amplifier includes a preamplifier 50A and a valve power amplifier 50B driving an input of an intermediate user-adjustable sound coloration processor 620 of an emulation unit 600. An output of the user-adjustable sound coloration processor 620 is employed to drive a high-quality sound amplification system 700 designed to generate a low degree of sound coloration. Optionally, the user-adjustable sound coloration processor 620 is adapted to apply a compensation for coloration introduced by the sound amplification system 700 for obtaining more convincing emulations or simulations of different types of characterized amplifier and associated loudspeaker arrangements, for example Marshall, Fender, Vox, et al.; "Marshall", "Fender" and "Vox" are registered trade marks (®). The coloration processor 620 is implemented using a digital signal processing device which has stored in its data memory one or more of the impulse responses 250 and includes computing hardware for implementing software recorded on a machine-readable data carrier for applying the impulse responses 250 to a signal output from the power amplifier 50B to provide a signal to drive the high-quality sound amplification system 700 for enabling the combo amplifier 50A, 50B to be employed to simulate sound coloration characteristics of other types of famous and/or popular amplifier-loudspeaker-systems.

An alternative commercial application of the present embodiment is in software products to be sold to recording studios and private musicians for use in processing musical sounds for simulating effects of given valve amplifiers and speaker arrangements by way of software applications which can be used to process recorded sound file, for example specific musical instrument tracks of a multi-track recorded composition.

Figure 9:
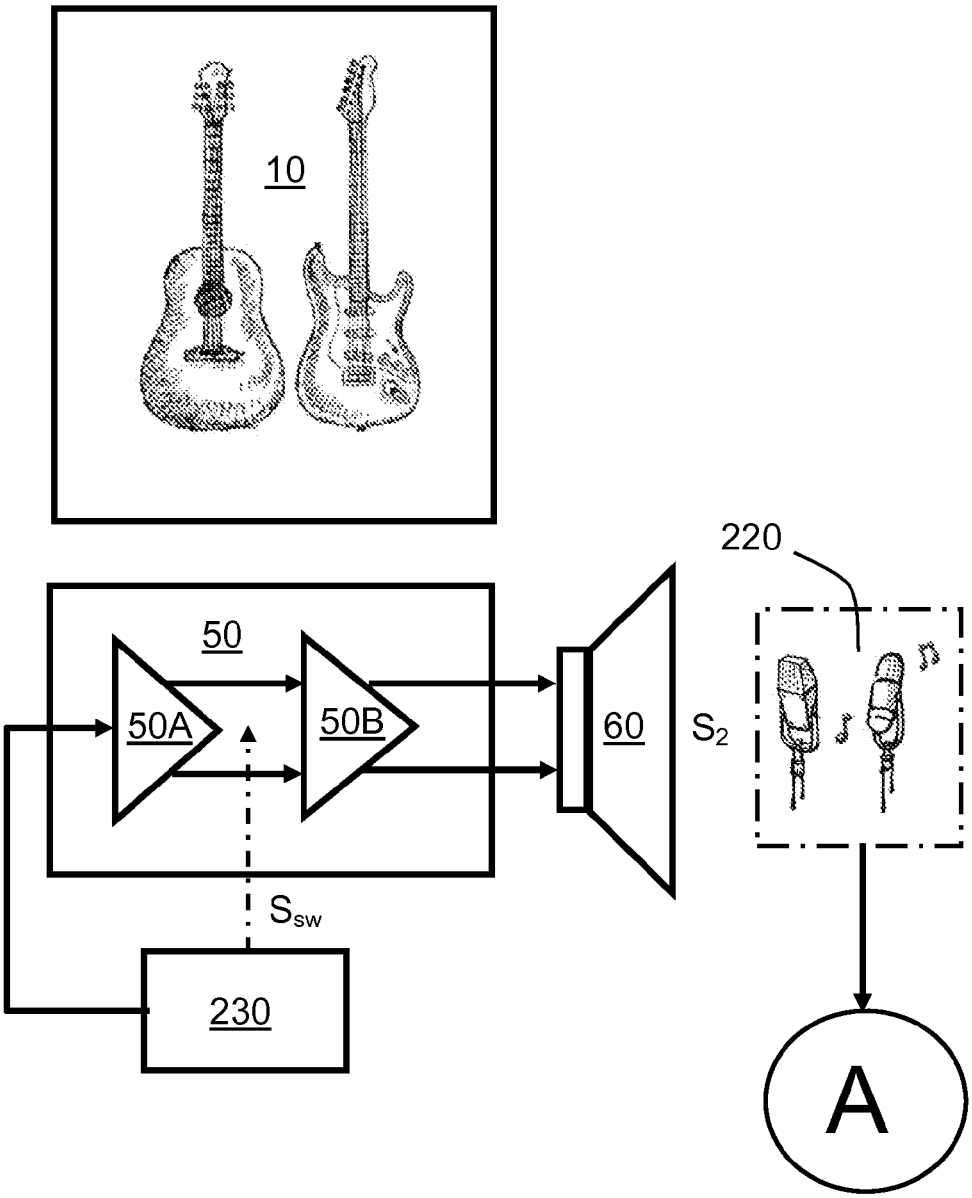
FIG. 9 is an illustration of an alternative measuring set-up for measuring a first signal A based on a combination of an amplifier, a microphone arrangement and a loudspeaker arrangement.

For further describing the present embodiment, various alternative methods of measuring and computing an impulse response will now be elucidated. In a first method, following steps are executed:

STEP 1: in FIG. 9, a sweep signal $S_{sw}$ is applied to an amplifier 50, either at its guitar input for coupling to a guitar 10 or at a point between a power amplifier 50A and a preamplifier 50B of the amplifier 50. The power amplifier 50B is coupled to a loudspeaker arrangement 60, for example via external cables or internally when implemented as a "combo". The sweep signal $S_{sw}$ is applied and a corresponding acoustic output $S_2$ is recorded using a microphone arrangement 220 to generate a first signal sample A. Beneficially, signals relating to several different microphone arrangement 220, e.g. microphone placement, and loudspeaker arrangement 60 combinations are measured to generate the first signal sample A.

Figure 10:
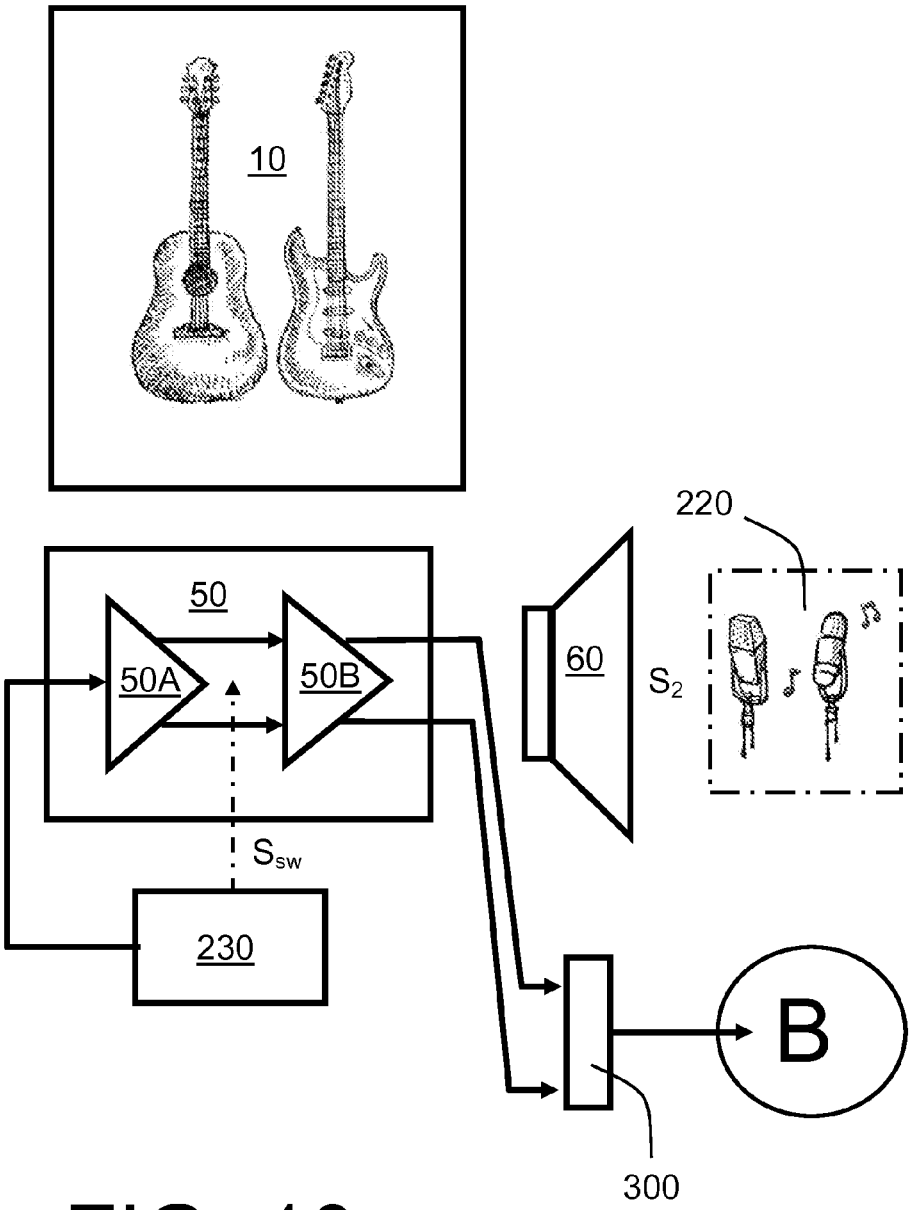
FIG. 10 is an illustration of a further alternative measuring set-up for measuring a second signal B based on a combination of the amplifier in FIG. 8 and a dummy load coupled to the amplifier.

STEP 2: in FIG. 10, the amplifier 50 is connected to a dummy load 300 from which an attenuated signal is derived for providing a second signal sample B. The sweep signal $S_{sw}$ is applied as in STEP 1 to generate the second signal sample B. Beneficially, the loudspeaker arrangement 60 is disconnected in STEP 2 when generating the second signal sample B.

STEP 3: the signals samples A and B together with a representation of the corresponding sweep signal $S_{sw}$ is provided to the DSP 210 wherein the samples A and B are analyzed via a processing algorithm as aforementioned to generate a corresponding impulse response 250. The impulse response 250 is subsequently susceptible to being used to simulate in the aforesaid synthesis-phase amplification and coloration characteristics of the loudspeaker 60, microphone arrangement 220, and possibly the amplifier 50 in FIG. 9 and FIG. 10. The processing algorithm is beneficially implemented using for example a de-convolution operation, or FFT and/or IFFT; for example, de-convolution is beneficially executed using commercial and/or open-source convolution software. The impulse response 250 is stored in data memory, for example a data base, for subsequent use in the synthesis-phase.

The present embodiment is optionally adapted to provide additionally a sound copy functionality, wherein a user is able to copy guitar sounds from other guitarists or recording (LP/CD and similar) and process the copied sounds to provide them with a desired degree of sound coloration.

In a first manner of implementing the copy function, it is required that the desired distorted guitar sound from a mimicked loudspeaker and a dry undistorted and uncolored sound signal from a guitar 10; the user then adjusts the amplifier distortion applied to the dry undistorted and uncolored sound signal until it resembles the desired guitar sound. Next, the user inputs the dry sound signal as the signal $S_1$ into the amplifier 50. Then either the drive signal (Samp) or the acoustic output (S2) is recorded and subjected to de-convolution or other signal processing operation to generate a corresponding impulse response 250 which includes a difference between the distorted target sound and the users own distorted sound. The impulse response 250 is then stored in data memory, for example in a database, for future use by the user by way of a convolution.

In a second manner of implementing the copy function, it is required that the user inputs a self-played musical excerpt resembling an original excerpt. The self-play excerpt is then employed as the aforementioned dry signal. De-convolution is then applied between the self-played excerpt and the distorted signal to obtain a corresponding impulse response 250. This copy functionality thereby enables a given coloration to be identified and mimicked by the user.

Figure 11:
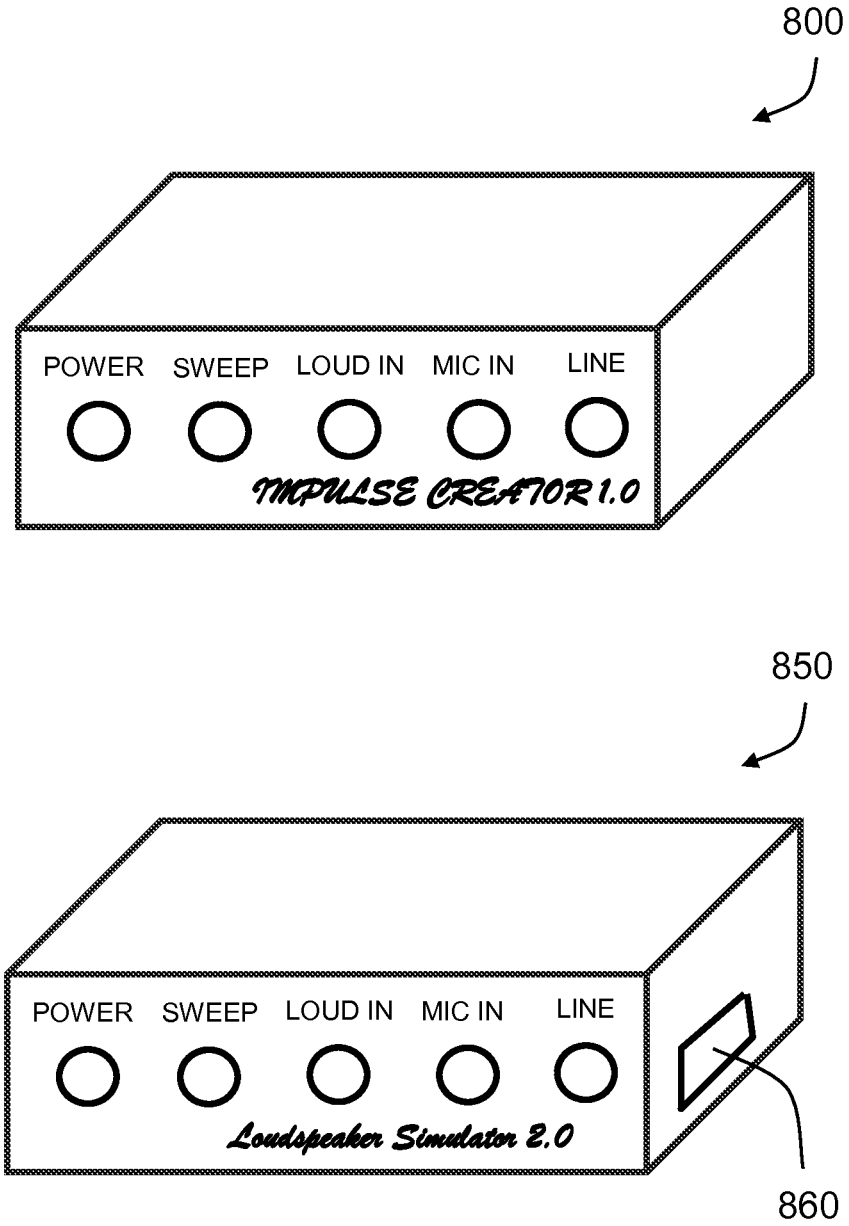
FIG. 11 is an illustration of an embodiment of devices for storing impulse sounds pursuant to the present invention.

The present embodiment is capable of being implemented using devices as illustrated in FIG. 11. Optionally, two devices 800, 850 can be used for implementing aforesaid analysis-phase and simulation-phase respectively; conveniently, the devices 800, 850 are provided as user-adjustable modules, for example "Impulse Creator 1.0" and "Loudspeaker Simulation 2.0". The devices 800, 850 include various controls for adjusting signal levels as well as connection sockets to receive and output signals. There is beneficially also provided on one or more of the devices 800, 850 and digital input/output interface. The devices 800, 850 include the aforementioned DSP 210, together with one of more computer software products recorded on machine-readable data storage media, for example ROM and/or RAM. Optionally, at least one of the devices 800, 850 is implemented by using a standard personal computer (AppleMac, IBM Thinkpad or similar, these names being trademarks of Apple Corp. and IBM respectively) for providing computer processing power and data storage.

Modifications to the various embodiments of the invention described in the foregoing are possible without departing from the scope of the invention as defined by the accompanying claims. Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural. Numerals included within parentheses in the accompanying claims are intended to assist understanding of the claims and should not be construed in any way to limit subject matter claimed by these claims.

The invention claimed is:

1. A method of measuring an impulse response, wherein said method includes:

(a) coupling directly to a connection between an amplifier (50) and a loudspeaker arrangement (60) for obtaining access to a drive signal ($S_{amp}$) applied to the loudspeaker arrangement (60) to generate an acoustic output ($S_2$), wherein said drive signal ($S_{amp}$) is derived by placing a dummy load (300) in parallel with connection to one or more drivers (100) of the loudspeaker arrangement (60);

(b) disposing a microphone arrangement (220) for receiving the acoustic output ($S_2$) of the loudspeaker arrangement (60);

(c) using a test signal generator (230) to apply a test signal ($S_{sw}$) to an input of the amplifier (50); and (d) receiving at a digital signal processing arrangement (DSP, 210) at least the drive signal ($S_{amp}$) and the acoustic output ($S_2$) corresponding to the test signal ($S_{sw}$) and performing on these signals a signal processing operation for determining an impulse response (250) for at least one of: the amplifier (50), the loudspeaker arrangement (60).

2. A method as claimed in claim 1, wherein the method, for determining the impulse response (250), includes measuring at least one of:

(i) a harmonic sound coloration resulting from thermionic electron tube non-linear transfer properties in respect of the amplifier (50);

(ii) a harmonic sound coloration resulting from output transformer non-linear coupling properties in respect of the amplifier (50);

(iii) a harmonic sound coloration resulting from Doppler frequency shift occurring within one or more drivers (100) of the loudspeaker arrangement (60) arising from dynamic diaphragm movements;

(iv) a harmonic coloration resulting non-linear properties of diaphragm suspension components of one or more drivers (100) of the loudspeaker arrangement (60); and (v) one or more cavity and/or structural resonances of one or more cabinets (100) employed for the loudspeaker arrangement (60), and their associated one or more drivers (100).

3. A method as claimed in claim 1, wherein the method includes employing the test signal generator (SWP, 230) to apply a sweep frequency signals and/or a broad band test signal comprising a simultaneous plurality of signal components.

4. A method as claimed in claim 3, wherein the method includes driving the amplifier (50) at a plurality of power output levels in the acoustic output ($S_2$), and determining the impulse response (250) in respect of each of the plurality of power output in the acoustic output ($S_2$).

5. A method as claimed in claim 1, wherein said signal processing operation is a convolution which is performed using at least one of:

(a) time-domain convolution;

(b) Fast Fourier Transform (FFT) and/or Inverse Fast Fourier Transform (IFFT); and (c) one of more physical models describing transfer characteristics of active components present in the amplifier (50) and/or the speaker arrangement (60).

6. A method as claimed in claim 1, wherein said method is adapted to provide a copy functionality for mimicking one or more target sound colorations, wherein a user is able to copy guitar sounds from other guitarists or recording and process the copied sounds to provide them with a desired degree of sound coloration.

7. An apparatus (210, 220, 230) for use in performing measuring an impulse response, wherein said apparatus (210, 220, 230) includes:

(a) a coupling arrangement for coupling directly to a connection between an amplifier (50) and a loudspeaker arrangement (60) for obtaining access to a drive signal ($S_{amp}$) applied to the loudspeaker arrangement (60) to generate an acoustic output ($S_2$), wherein said drive signal ($S_{amp}$) is derived by placing a dummy load (300) in parallel with connection to one or more drivers (100) of the loudspeaker arrangement (60);

(b) a microphone arrangement (220) for receiving the acoustic output ($S_2$) of the loudspeaker arrangement (60);

(c) a test signal generator (230) for applying a test signal ($S_{SW}$) to an input of the amplifier (50); and (d) a digital signal processing arrangement (DSP, 210) for receiving at least the drive signal ($S_{amp}$) and the acoustic output ($S_2$) corresponding to the test signal ($S_{SW}$) and for performing on these signals a signal processing operation for determining an impulse response (250) for at least one of: the amplifier (50), the loudspeaker arrangement (60).

8. An apparatus (600) as claimed in claim 7, wherein said digital signal processing arrangement (620) further applies said one or more impulse responses to a program signal propagating through said apparatus.

9. An apparatus (600) as claimed in claim 8, wherein said apparatus is implemented as a combo amplifier including said signal processing arrangement (620), an amplifier (50) and a loudspeaker arrangement (60), wherein the signal processing arrangement (620) is operable to apply in a user-electable manner said one or more impulse responses to one or more signals passing through said amplifier (50) to drive said loudspeaker arrangement (60).

10. An apparatus as claimed in claim 9, wherein the signal processing arrangement (620) is operable to apply solely an impulse response of one or more loudspeaker arrangements, so that an acoustic output (S2) from the loudspeaker arrangement (60) only includes harmonic coloration from one valve amplifier.

11. A computer program product for measuring an impulse response, the computer program product comprising a non-transitory computer readable storage medium having program instructions embodied therewith, the program instructions being executable by a processor to cause the processor to:

receive at least a drive signal ($S_{amp}$) and an acoustic output ($S_2$) corresponding to a test signal ($S_{SW}$), wherein the drive signal ($S_{amp}$) is derived by coupling directly to a connection between an amplifier (50) and a loudspeaker arrangement (60) and placing a dummy load (300) in parallel with a connection to one or more drivers (100) of the loudspeaker arrangement (60) to generate the acoustic output, ($S_2$), and wherein the test signal ($S_{SW}$) is applied by a test signal generator (230) to an input of the amplifier (50) the acoustic output ($S_2$is received b a micro hone disposed to receive the acoustic output of the loudspeaker arrangement (60); and perform on the received signals a signal processing operation for determining an impulse response (250) for at least one of: the amplifier (50) and the loudspeaker arrangement (60).

* * * * *